United States Patent [19]

Miyashita et al.

[11] Patent Number: 4,528,074

[45] Date of Patent: Jul. 9, 1985

[54] METHOD FOR PRODUCING A GRINDING WHEEL BY ELECTROPLATING

[75] Inventors: Masakazu Miyashita, Kokubunji; Akira Kanai, Higashiyamato; Junichi Yoshioka, Chiba; Koichi Koizumi, Matsudo; Fukuo Hashimoto, Hachioji; Michimasa Daito; Takashi Hasebe, both of Hamamatsu, all of Japan

[73] Assignee: Nissin Machine Works, Limited, Hamamatsu, Japan

[21] Appl. No.: 585,293

[22] Filed: Mar. 1, 1984

[30] Foreign Application Priority Data

Mar. 2, 1983 [JP] Japan ..... 58-34185

[51] Int. Cl.[3] ..... C25D 15/00

[52] U.S. Cl. ..... 204/16; 204/217

[58] Field of Search ..... 204/16, 25, 40, 212, 204/217

[56] References Cited

U.S. PATENT DOCUMENTS

| | | | |
|---|---|---|---|
| 1,271,136 | 7/1918 | Cook | 204/16 |
| 2,020,117 | 11/1935 | Johnston | 204/16 |
| 2,424,140 | 7/1947 | Beecher | 204/16 |

*Primary Examiner*—Thomas Tufariello

*Attorney, Agent, or Firm*—McAulay, Fields, Fisher, Goldstein & Nissen

[57] ABSTRACT

Disclosed is a method of producing a grinding wheel by electroplating. A part of the outer peripheral portion of a grinding wheel body is immersed in a plating solution. While rotating the grinding wheel body at a low speed, electric current is supplied to flow between an anode disposed in the plating solution and a cathode contacting the grinding wheel body, so that a pre-plating layer of uniform thickness is formed on the outer peripheral surface of the grinding wheel body. Plating operation is continued while adhering abrasive grains to the pre-plating layer to further cause a precipitation of a plating layer to temporarily fix the abrasive grains. The abrasive grains are then pressed by a pressing roller so as to be forcibly embedded into the pre-plating layer by making an effective use of plastic deformation of the pre-plating layer, thereby to obtain a uniform projection height of the abrasive grains from the surface of the grinding wheel. Then, a final plating is conducted to finally fix the abrasive grains. Disclosed also is an apparatus suitable for use in carrying out this method.

8 Claims, 4 Drawing Figures

METHOD FOR PRODUCING A GRINDING WHEEL BY ELECTROPLATING

BACKGROUND OF THE INVENTION

The present invention relates to a method of and apparatus for producing a grinding wheel by electrodeposition or electroplating.

As one of the methods for producing a super-grain grinding wheel having abrasive grains of diamond or other super abrasive grains, a method called electrodeposition process has been known in which abrasive grains are fixed to the body of the grinding wheel by means of a plating layer formed on the grinding wheel body through an electrodeposition, i.e. an electroplating.

In the grinding wheel produced by this method, however, the projection height of the abrasive grains on the surface of the grinding wheel is inevitably made irregular. If a work is ground by such a grinding wheel having irregular projection height of abrasive grains, the surface of the product will be undesirably coarsened and the shape and precision of the product would be degraded disadvantageously. For this reason, the grinding wheel produced by this method could not be used suitable in the precision grinding which requires a specifically high precision of the product.

SUMMARY OF THE INVENTION

The invention aims at overcoming the above-described problem of the prior art.

Accordingly, it is a primary object of the invention to provide a method of and an apparatus for producing a grinding wheel by electroplating, wherein the abrasive grains are forcibly embedded into the plating layer by making an effective use of a plastic deformation of the plating layer, thereby to obtain a uniform height of projection of the abrasive grains on the grinding wheel surface.

To this end, according to one aspect of the invention, there is provided a method of producing a grinding wheel by electroplating comprising the steps of: immersing a part of the peripheral portion of a grinding wheel body in a plating solution; causing an electric current to flow between an anode in the plating solution and a cathode contacting the grinding wheel body while rotating the grinding wheel body at a low speed, thereby to form a pre-plating layer on the outer peripheral surface of the grinding wheel body; continueing the plating while adhering abrasive grains to the pre-plating layer to temporarily fix the abrasive grains; feeding a rotating pressing roller into pressure contact with the abrasive grains after the plating thereby to forcibly embed the abrasive grains into the pre-plating layer through making an effective use of the plastic deformation of the plating layer so as to obtain a uniform height of projection of the abrasive grains; and effecting a final plating thereby to finally fix the abrasive grains.

According to another aspect of the invention, there is provided an apparatus for producing a grinding wheel by electroplating comprising: a machine frame; a mounting base disposed on one end portion of the machine frame and fixedly mounting a stationary shaft thereon, the stationary shaft carrying, through an intermediary of a bearing, a grinding wheel body having an inner bore constituting the rotation reference surface; a plating cell disposed under the grinding wheel body and containing a plating solution in which a part of the outer peripheral portion of the grinding wheel body is immersed; an anode disposed in the plating solution; a cathode contacting the grinding wheel body; a feed plate disposed on the other end portion of the machine frame and adapted to be moved toward and away from the grinding wheel body; a traversable carriage mounted on the feed plate; a pressing roller carried by the carriage and adapted to be positioned to oppose to the grinding wheel body; and a motor for driving the pressing roller.

These and other objects, features and advantages of the invention will become clear from the following description of the preferred embodiments taken in conjunction with the accompanying drawings.

BRIEF DESCRIPTION OF THE DRAWINGS

The accompanying drawings in combination show an embodiment of an apparatus for producing a grinding wheel by electroplating in accordance with the invention in which.

DESCRIPTION OF THE PREFERRED EMBODIMENTS

Figure 1:
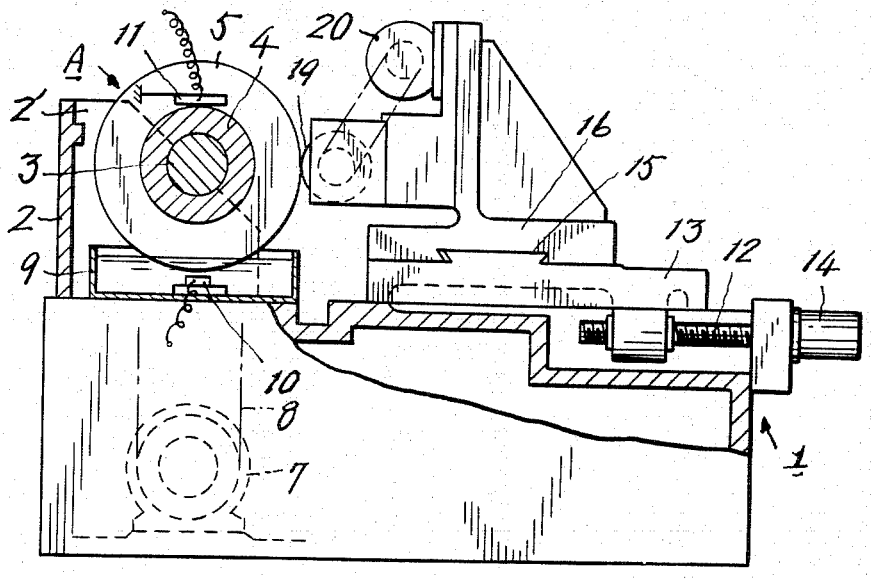
FIG. 1 is a side elevational view.
Figure 2:
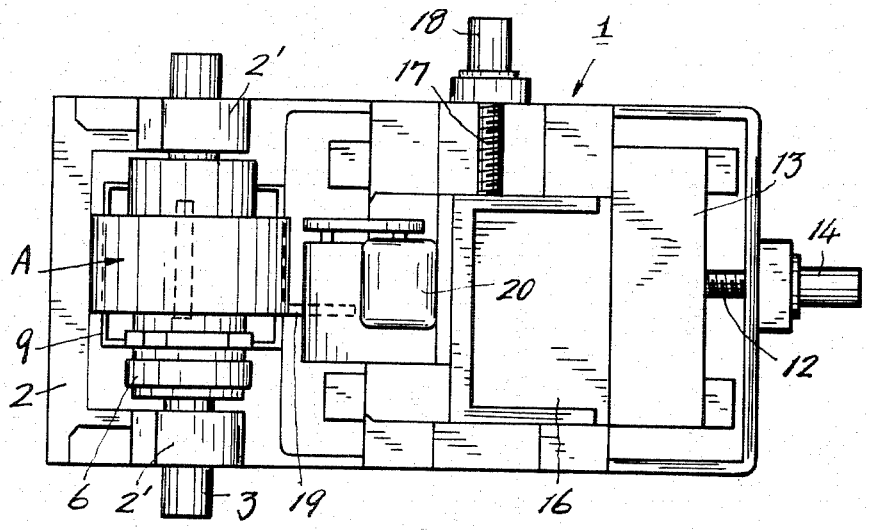
FIG. 2 is a plan view.
Figure 3:
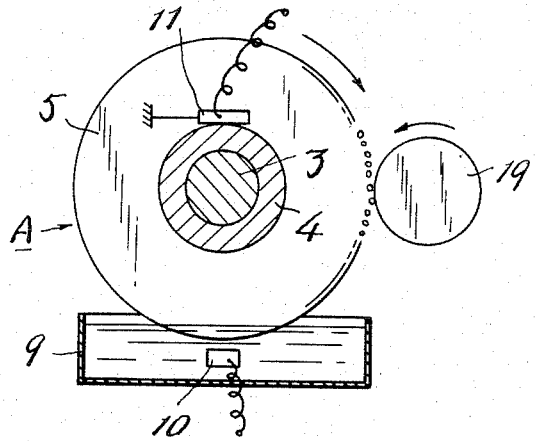
FIG. 3 is an enlarged view of a part of the apparatus.
Figure 4:
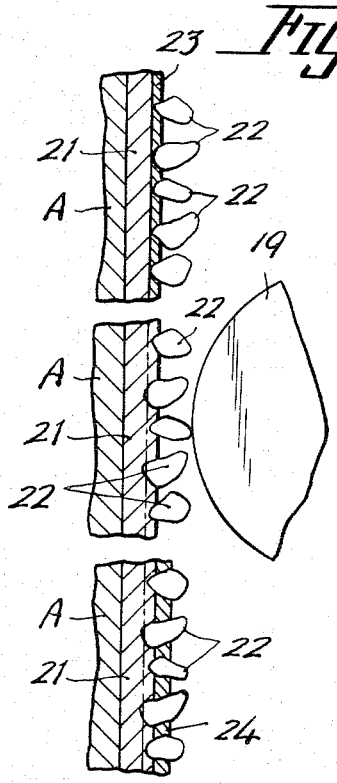
FIG. 4 is an illustration of the process for producing the grinding wheel.

An embodiment of the apparatus for producing a grinding wheel by electroplating in accordance with the invention will be described hereinunder with reference to the accompanying drawings.

The apparatus has a machine frame 1 provided at one end portion thereof with a mount base 2 including a pair of supports 2',2' opposing to each other. The upper ends of the supports 2',2' are divided into two parts and are adapted to securely hold a stationary shaft 3 at both ends of the latter.

The stationary shaft 3 carries, through a hydrostatic bearing, the body A of a grinding wheel which is integrally constituted by a sleeve 4 and wheel member 5. The sleeve 4 is provided at its one end with a driving pulley 6 and has a bore formed therein. The surface of the bore in the sleeve 4 presents a rotation reference surface. The driving pulley 6 is drivingly connected through a belt 8 to a motor 7 mounted in the machine frame 1 so that the body A of the grinding wheel is driven by the motor 7. The machine frame 1 carries also a plating cell 9 disposed at the lower side of the body A of the grinding wheel so as to oppose to the latter. The plating cell 9 is provided with an anode 10, while a cathode 11 is disposed in contact with the grinding wheel body A. The arrangement is such that, as electric current flows between the anode 10 and the cathode 11 while rotating the grinding wheel body A at a low speed, the surface of the wheel member 5 is plated with the plating material in the cell 9. A feed screw shaft 12 is screwed into a feed plate 13 disposed on the other end portion of the machine frame 1. The feed plate 13 is movable toward and away from the grining wheel body as the feed screw shaft 12 is rotated in one and the other directions by a feed motor 14.

A sliding surface 15 perpendicular to the direction of the feed is provided on the feed plate 13. This sliding surface 15 slidably carries a carriage 16 which is engaged by a traverse screw shaft 17 adapted to be driven by a traversing motor 18. Consequently, the carriage 16 is reciprocatingly driven by the traversing motor 20. The carriage 16 carries a pressing roller 19 opposing to the body A of the grinding wheel and a motor 20 for driving the pressing roller 19. The pressing roller 19 has been ground on the machine frame at a high precision in a manner to avoid any oscillation. After pre-plating the surface of the grinding wheel body, abrasive grains are adhered to the pre-plated surface and an additional plating is conducted to temporarily fix the abrasive grains. Then, the pressing roller 19 is fed towards the body A of the grinding wheel while being rotated under traversing operation to embed the abrasive grains into the pre-plating layer by making an efficient use of the plastic deformation of the pre-plating layer, thereby to attain a uniform height of projection of the abrasive grains on the surface of the grinding wheel.

More specifically, with the apparatus having the construction described hereinbefore, the grinding wheel is produced in accordance with the following method according to the invention.

As the first step, the pressing roller 19 is spaced apart from the grinding wheel body A, and a part of the outer peripheral portion of the grinding wheel body A is immersed in the plating solution contained by the plating cell 9. Then, an electric current is made to flow between the anode in the plating cell and the cathode contacting the grinding wheel body while rotating the grinding wheel body A at a low speed. Consequently, a uniform pre-plating layer 21 is formed on the outer peripheral surface of the grinding wheel body A. Then, abrasive grains 22 are adhered by an adhesive to the surface of the pre-plating layer 21 and the plating is further continued to cause a precipitation of a plating layer 23. Preferably, the plating layer 23 has a thickness of about $\frac{1}{4}$ of the abrasive grain size. In the state, the abrasive grains project by irregular or different heights from the surface of the plating layer 23. After the plating, the pressing roller 19 is fed while being rotated under a suitable traverse driving. As a result, the abrasive grains 22 having comparatively large projecting heights are first contacted by the pressing roller 19 and are pressed and embedded into the pre-plating layer 21 on account of a plastic deformation of the latter. As this operation is continued, the abrasive grains of smaller projections heights are successively embedded into the pre-plating layer 21 and, accordingly, the projection heights of the abrasive grains 22 are uniformalized advantageously. It will be understood that the uniform projection height of the abrasive grains can be attained over the entire area of the grinding wheel surface by traversing the rotating pressing roller 19. After a uniform projection height of the abrasive grains is obtained, a final plating is conducted to form a plating layer 24 thereby to finally fix the abrasive grains 22.

As has been described, the invention provides a method of producing a grinding wheel by electroplating having the steps of: immersing a part of the pripheral portion of a grinding wheel body; causing an electric current to flow between an anode in a plating solution and a cathode contacting the grinding wheel body while rotating the grinding wheel body at a low speed, thereby to form a pre-plating layer on the outer peripheral surface of the grinding wheel body; continueing the plating while bonding abrasive grains to the pre-plating layer to temporarily fix the abrasive grains; feeding a rotating pressing roller into pressure contact with the abrasive grains after the plating thereby to forcibly embed the abrasive grains into the pre-plating layer through making an effective use of the plastic deformation of the plating layer thereby to attain a uniform height of projection of the abrasive grains; and effecting a final plating thereby to finally fix the abrasive grains. The grinding wheel having abrasive grains now fixed finally to the grinding wheel body is transferred together with the stationary shaft to a processing machine. Since the grinding wheel with the abrasive grains is transferred as a unit with the bearing, the precision of the grinding wheel is never degraded by this transfer. Furthermore, since the abrasive grains are forcibly embedded into the plating layer by making an effective use of the plastic deformation of the latter, it is possible to obtain a grinding wheel having a uniform projection height of the abrasive grains and operable without any oscillation, thereby to ensure an extremely high precision in the grinding.

Although the invention has been described through specific terms, the described embodiments are only illustrative and various changes and modifications may be imparted thereto without departing from the scope of the invention which is limited solely by the appended claims.

What is claimed is:

1. The method of producing a grinding wheel comprising the steps of:

providing a grinding wheel having an integral grinding wheel body and sleeve, said sleeve having a bore to provide a predetermined rotation reference surface, applying a first layer having plastic deformation to a grinding wheel body, adhering abrasive grains to said first layer to temporarily fix said abrasive grains, applying a second layer having plastic deformation to partially cover said grains, obtaining a substantially uniform height of projection of said abrasive grains relative to said rotation reference surface by feeding a rotating pressing roller into pressure contact with said abrasive grains after said step of applying said second layer, said abrasive grains thereby being forced to move into said first layer and within said second layer through making effective use of the plastic deformation of said layers.

2. The method of claim 1 wherein said first layer is substantially thicker than said second layer.

3. The method of claim 2 wherein said second layer has a thickness of about one-fourth of the abrasive grain size.

4. The method of claim 1 wherein said steps of applying constitute the electroplating of said first and second layers on said grinding wheel by immersing said grinding wheel body in a plating solution and causing an electric current to flow between an anode in the plating solution an a cathode in contact with said grinding wheel body while rotating said grinding wheel body at a low speed.

5. The method of claim 1 wherein said step of adhering abrasive grains to said first layer precedes said step of applying said second layer.

6. The method of claim 1 wherein said step of applying said second layer occurs substantially subsequent to said step of adhering said abrasive grains.

7. The method of claim 1 further comprising the step of: applying a final layer to finally fix said abrasive grains.

8. The method of claim 4 further comprising the step of: effecting a final plating thereby to finally fix said abrasive grains.

* * * * *